United States Patent [19]

Hartmann

[11] 4,363,845

[45] Dec. 14, 1982

[54] SPUN NON-WOVEN FABRICS WITH HIGH DIMENSIONAL STABILITY, AND PROCESSES FOR THEIR PRODUCTION

[75] Inventor: Ludwig Hartmann, Kaiserlautern, Fed. Rep. of Germany

[73] Assignee: Carl Freudenberg, Fed. Rep. of Germany

[21] Appl. No.: 252,024

[22] Filed: Apr. 8, 1981

Related U.S. Application Data

[63] Continuation of Ser. No. 69,921, Aug. 27, 1979, abandoned.

[30] Foreign Application Priority Data

Jun. 1, 1979 [DE] Fed. Rep. of Germany ..... 2922427

[51] Int. Cl.[3] ..... D04H 1/58

[52] U.S. Cl. ..... 428/198; 156/62.2; 156/62.6; 264/75; 428/284; 428/286; 428/287; 428/288; 428/291; 428/296; 428/904

[58] Field of Search ..... 428/198, 284, 286, 287, 428/288, 291, 296, 904; 264/75; 156/62.2, 62.6

[56] References Cited

U.S. PATENT DOCUMENTS 3,554,854 1/1971 Hartmann ..... 264/75

4,107,374 8/1978 Kusunose ..... 428/296

*Primary Examiner*—Marion McCamish

*Attorney, Agent, or Firm*—Keil & Witherspoon

[57] ABSTRACT

Non-woven fabrics made from spun, synthetic polymer filaments and composed of several superposed layers of interbonded monofilaments and multifilament strands deposited in a tangled form; at least segments of the individual filaments of the multifilament strands being disposed parallel to one another with total or partial bonding together of the parallel filaments, and the individual filaments and the multifilament strands being bonded together at least at the points of their random crossings.

19 Claims, 8 Drawing Figures

SPUN NON-WOVEN FABRICS WITH HIGH DIMENSIONAL STABILITY, AND PROCESSES FOR THEIR PRODUCTION

This is a continuation, of application Ser. No. 069,921, filed Aug. 27, 1979, now abandoned.

INTRODUCTION

The invention relates to a spun non-woven fabric of several superposed layers of filaments deposited in a tangled manner which are bonded to one another. As a result of a special arrangement of the filaments hitherto not achieved characteristics of use are achieved, especially a high dimensional stability and a particularly favorable modulus.

PRIOR ART

Spun non-woven fabrics as such are known. Their use as carrier material for a plastic coating in the meantime has become part of the state of the art. For traditional PVC or polyurethane coating, one uses above all polyamide and polypropylene spun non-woven fabrics with weights per unit area of 40 to 120 g/m$^2$. Thicker and heavier carrier non-woven fabrics are produced preferably from needled staple fiber non-woven fabrics, e.g., for processing into poromeric synthetic leathers. Most of these carrier materials serve for the production of coated synthetic leathers which are used in the purse and luggage making industry, in the case of shoe manufacture, for leather-like clothing or in the furniture industry. For processing at high tensile strain, these fabric material types are not suitable.

Spun non-woven fabric carrier materials for the tufting area are described in German Pat. No. 22 40 437, wherein it is pointed out that such high strength spun non-woven fabrics are bonded preferably by autogenous filament bonding. The spun non-woven fabrics produced thus are quite successful as dimensionally stable carrier materials for the production of tufted carpets. The polyester non-woven fabrics bonded with copolyester filaments however are highly porous and have an open structure in order to facilitate the penetration of the tufting needles.

Such highly porous non-woven fabrics however are not desired in many cases and a number of novel coating products requires as smooth as possible carrier materials with compact surfaces, which necessitate over higher strength, stronger binding and very high moduli at elevated temperatures. Especially in the case of coating with bitumen for roof sheetings as well as with PVC for relief floor coverings (cushioned vinyl), carriers with a high modulus are needed. Large scale industrial processing at the same time requires highest tensile forces of more than 800 newton/5 cm strips at highest tensile elongations of below 60% and a minimal shrinkage in width, of below 100 mm at a coating temperature of 200° C. and 4 m sheet width.

Both the usual non-woven fabrics from staple fibers as well as hitherto known spun non-woven fabrics from continuous filaments could not fulfill the combination of the above sketched requirements. Especially the temperature dependent modulus is unsatisfactory in all cases, because in the case of a rising temperature, too strong a change toward higher values and thus greater elongations or deformations will result. This is true for spun non-woven fabrics bonded with the help of binder fibers as well as with dispersions.

BRIEF DESCRIPTION OF THE INVENTION

At the root of the invention is the problem of developing a non-woven fabric material which does not have the previously described disadvantages and which results especially in high dimensional stability and very high moduli at elevated temperatures. According to the invention, the problem is solved by a multifilament spun non-woven fabric in which a multiplicity of filament groups and individual filaments are intermixed and bonded with the filament groups at least at their points of intersection, for which secondary binders are preferred. Furthermore, an especially preferred process for the production of such spun non-woven fabrics is proposed.

In the case of the spun non-woven fabric, we are thus dealing with a mixed non-woven fabric of individual filaments distributed in a random manner mixed with multifilament strands produced by the help of secondary binding systems. Secondary binding systems according to the invention are such high polymer binding substances which are not extruded as filaments like the binder fibers, but are produced as a consequence of the primary spinning process.

From U.S. Pat. No. 3,554,854, it is already known to produce spun non-woven fabrics from parallel groups of filaments, whereby the filament groups are guided on a parallel way from the spinneret to the receiving zone and at the same time are deposited on one another in layers. The individual filaments forming groups of filaments at the same time in their parallel configuration are not bonded with the help of secondary binders into multifilaments but are subjected as a complete web to binding at the points of intersection. Thus, no structuring of a mixed web from multifilaments and individual filaments takes place as a result of web formation by superimposition. The filament groups are layed down laminarly. This laminar stacking at the same time makes the webs from filament groups different from crimped voluminous mattings, such as, for example, those produced as in the U.S. Pat. No. 2,736,676 from glass fiber strands. It turned out that the glass fiber strands according to the process described in the U.S. Pat. No. 2,736,676 have too high an elongation under tensile stress based on the curve-shaped deposition of the strands and on the basis of the lack of cohesion of the individual filaments obtained thereby, so that they could not be used for dimensionally stable spun non-woven fabrics.

The spun non-woven fabric proposed according to the invention is considered better in its characrteristics than the previously described spun non-woven fabrics. It differs first of all from those according to the U.S. Pat. No. 2,736,676 by its considerably improved dimensional stability. But it is also essentially better than the spun non-woven fabrics described in the U.S. Pat. No. 3,554,854, because the filament groups or multifilaments are mixed with individual filaments, and the filament groups are not bonded autogenously but are bonded together with the help of secondary binding substances, whereby so-called multifilaments develop. The individual filaments serve to stabilize the entire mixed web, for example, as binding fibers with a low softening point for bonding at the points of intersection.

According to the invention, the groups of filaments are deposited laminarly, that is to say without the formation of curves or crimps, such as exist, for example, in the U.S. Pat. No. 2,736,676. The filament groups may consist of a mixture of various individual filaments, for example, of thermoplastic filaments of various polymers bonded together with elastomers or duromers.

According to the invention furthermore, a particularly favorable process for the production of mixed webs is proposed, whereby the spun non-woven fabric mixed with individual filaments is built up from parallelized filament groups which are deposited laminarly superposed, so that a random deposition of filament groups of various numbers of filaments mixed with individual filaments is produced and the individual filaments within the groups are bonded with the help of secondary binding substances at least along portions of their parallel extents into interbonded multifilaments.

The laminar, superposed deposition of bonded filament groups, that is to say of multifilaments of varying numbers of filaments, mixed with randomly deposited individual filaments results in high strength as a result of the presence of the filament groups or interbonded multifilaments, while the individual filaments distributed therein serve as binding agents for the stabilization of the laminar bonds, either as binding fibers on the basis of their low softening point or they function during the application of secondary binders, for example, in the form of dispersions, on the basis of their free position and large surface area, as binding agents for the filaments.

An important advantage of the mixed non-woven fabric of structure multifilament groups and individual filaments according to this invention consists in the variation of the pore size of the spun non-woven fabric. As a result of that, the latter becomes suitable particularly as a carrier material for high loads. Thus, it is possible without difficulty to process the mixed non-woven fabrics by saturation with bitumen into roofing sheets. In order to avoid penetration by water (capillary effect) in the case of finished roofing sheets, a certain size of pores of the non-wovens must be regulated, so that during saturation with bitumen, a complete penetration will be achieved. Since on the other hand a predetermined weight by unit area of fibers is required for achieving the necessary strength (for example, 200 $g/m^2$ of polyester filaments), the pore size may be varied in producing the construction according to the invention by the ratio of multifilament groups mixed with individual filaments. This variation of the pore size is also urgently required in the case of processing of bitumen saturation mixtures of different viscosity. In the case of the deposition of the spun non-woven fabric only from traditional individual filaments, the number of pores and the size of pores for any given weight by unit area (200 $g/m^2$ according to the above example) are very much smaller than in the case of the deposition of a fabric of the same weight from multifilament strands of, e.g., groups of six. In other words, multifilament strands made from six individual filaments per group are closely coherent in parallel and as a result of the tangled position of the groups, they form many and large pores. Through the build-up of a web of certain percentages of multifilament groups mixed with individual filaments, a suitable carrier material with maximum saturation capacity may be found for any given weight per unit area depending on the bitumen viscosity.

The significance of the filaments bonded along their parallel lines in groups with the help of secondary binders may be explained by of the spun web methodology of aerodynamic drawing. As is well known, the filaments in the case of the spun web process are drawn out of the spinneret with the help of fast air currents. The orientation of the molecules occurring with melting down the molten hot monofilament must be set as quickly as possible, that is to say, the temperature of the filament must be brought below the glass transition point or the recrystallization temperature. Naturally, this process takes place best in the case of a thin filament with a correspondingly large surface. However, as strong as possible thick filaments are needed for high strength spun non-woven fabrics for technical applications, which are difficult to produce according to the aerodynamic spun web process as a result of the above described speeds of heat dissipation needed in order to achieve a maximum molecular orientation. According to the invention, these difficulties are overcome by spinning relatively thin filaments which are easily amenable to aerodynamic stretching in the form of groups, whereby the cooling is accomplished well as a result of the separation of the individual filaments in the groups during the spinning process, and thus a maximum orientation of the molecules and maximum strength will be achieved. After the deposition of the web, these individual filaments within the groups are then bonded together with the help of secondary binding substances into strands or multifilaments. As a result of that a spun non-woven fabric is obtained which achieves optimum values in strength, since its behavior is just as though it were built up from very thick high strength filaments or bristles. Very fine filaments result in particularly soft fabrics, rough filaments result in harder spun non-woven fabrics. For many areas of application a harder, stiffer spinning fleece is desired, for example, for the production of carrier materials for saturation with bitumen, for example, for roofing sheets or for the rehabilitation of roads or the strengthening of the bitumen layer in road construction.

The spinning of the individual filaments and the formation of multifilaments takes place thus in two processing steps which offer great advantages, as will be explained further below. The laminar, that is to say not crimped or not arcshaped, superimposed stacking of the filament groups or of the multifilaments together with individual filaments into a multifilament web produces very low elongation under load after the solidification of the web, that is, after the bonding together of the filament groups or individual filaments, also produces high modulus, even at elevated temperatures. A certain quantity of individual filaments is obtained either during deposition of the web by separating filament groups which are at first still unbonded, or else, as will be described later on, they are added by spinning. As a result of the variation of the ratio of multifilaments to individual filaments, the strength profile of the spun non-woven fabric may be varied considerably. In the case of the production of a roofing sheet, not only are tensile strength, edge tear strength and tearing strength essential, but also the nail tear-out strength and piercing strength are important factors. It turns out that an optimum tensile strength does not go in parallel with an optimum tearing strength, because in the case of the latter, a distribution of the stress over a larger surface is essential. This, in turn, may be controlled to a considerable extent by the ratio of filaments and multifilament groups. A proper build-up or mixture will also permit the possibility of optimizing in accordance with the requirement profile. Also the elongation capacity and the elasticity may be varied very much by this programmed mixed build-up, whereby it should be noted that in the practical use of these carrier non-woven fabrics, for example, for the production of roofing sheets, considerable technical advance is achieved. The traditional roofing sheets built up from glass fiber mats, for example, do not permit the adjustment of expansibility or elasticity, as a result of which, in the case of elongations occurring in the traditional flat roof, formation of tears occur continuously. The same is true in the case of use of these materials as patches for cracks in bituminous road coverings. In this case, the spun non-woven fabrics according to the invention have proven themselves excellently by absorbing the cracks and shifts coming from the foundation soil and keeping the bitumen cover (for example, thickness of application above the spun non-woven fabric 6 cm) free of cracks. A great variation in the elasticity may be regulated by varying the ratio multifilaments used to individual filaments.

PREFERRED EMBODIMENTS

Preferred, specific embodiments of the non-woven fabrics and processes of the inv;ention are described below, with the aid of the drawings, wherein.

Figure 1:
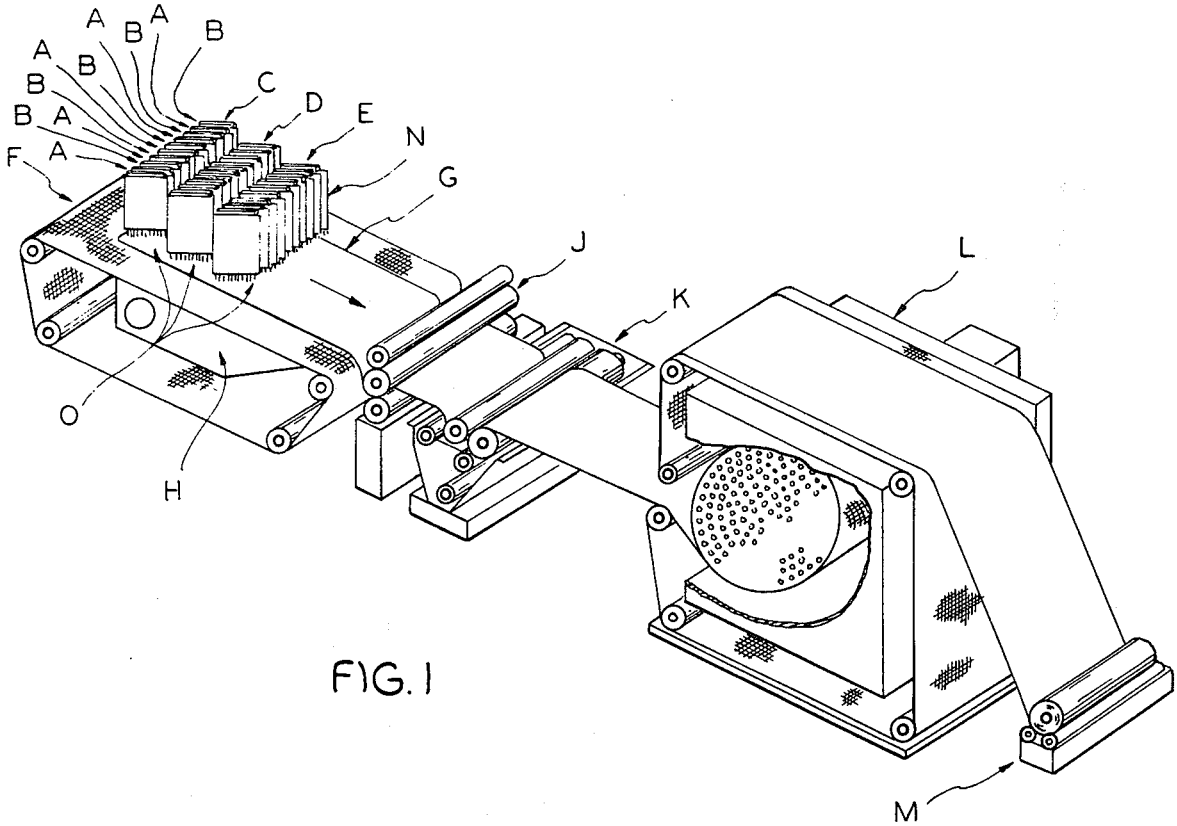
FIG. 1 is a perspective view of one embodiment of apparatus and machinery used to produce the subject non-woven fabrics.

FIG. 1 shows an apparatus for the production of the multifilament spun non-woven fabrics according to the invention. The letters A and B show longitudinal spinnerets in alternating arrangement, whereby the spinnerets A differ in their configuration of holes from the spinnerets B. The differences in the configuration of holes are described in more detail in FIG. 2. The spinnerets are mounted on a so-called spinning beam. FIG. 1 designates three of such series connected spinning beams with the letters C, D and E. The groups of filaments emerging from the spinnerets are guided with the help of air currents in the corresponding channels N on parallel paths to the receiving belt F (with an adjacent exhaust H). At the points of impact O they are deposited as a multifilament-individual filament mixed web G piled in a random arrangement. After leaving the receiving belt, the web is bonded thermally with the help of a calender with heated rolls J or is compressed and subsequently saturated in the padder K with a dispersion, e.g., of a modified polyacrylate. At the same time, the parallel groups of multifilaments are bonded among themselves and at their points of intersection with the individual filaments. The saturated non-woven fabric is dried with the help of a rotary dryer L and is rolled up at M.

Figure 2:
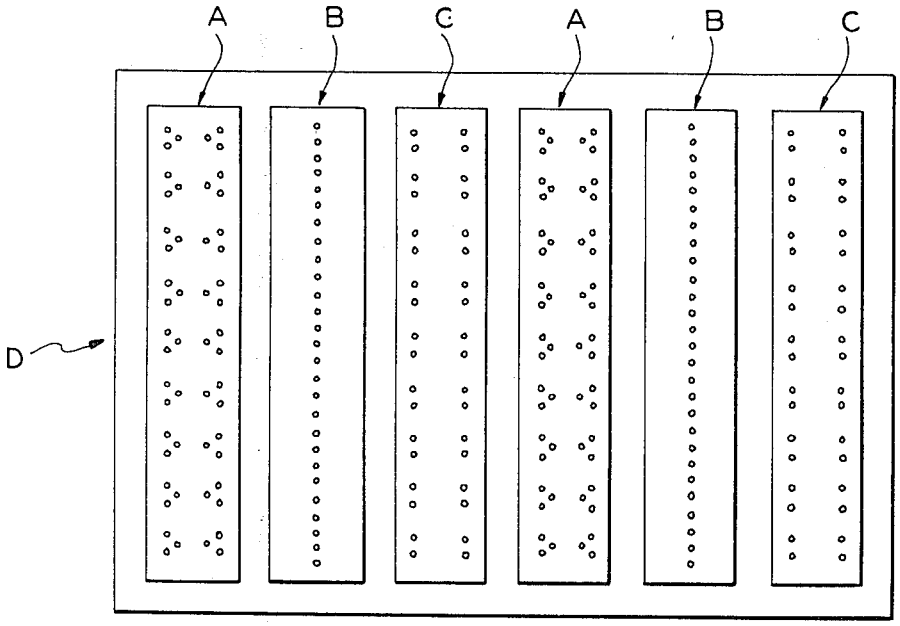
FIG. 2 is a plan view of a six-plate spinneret used to spin side-by-side groupings of filaments in different spatial configurations.

FIG. 2 shows the plan view of a part of the underside of a spinning beam D which shows three different types of spinnerets A, B, C in alternating arrangement. The spinnerets A, B and C differ in their configuration of holes, whereby A carries a triple combination of spinning holes which results in triple filament groups. The spinnerets B have a single row of holes which essentially produces one row of individual filaments, while the spinneret C carries two rows always of more closely adjacent rows of holes, which thus results in so-called twins, i.e., filament groups always with two filaments. The multifilament non-woven fabric may be built up differently by using any arbitrary configuration of holes with different arrangements of groups.

Controlled mixed non-woven fabrics may be built up from variable multifilament groups by using different configurations of holes of adjacent nozzles at any given time or as a result of equipping one spinning beam with spinnerets of only one configuration of holes and its adjacent beam with a different configuration of holes. The multifilaments may be mixed with individual filaments by inserting spinnerets with a corresponding configuration of holes, as shown in FIG. 2.

The superposed deposition may also be accomplished in such a way that, for example, the spinning beam B spins multifilaments essentially from parallel groups of 6 filaments, for example, while the adjacent beam E spins essentially individual filaments or vice versa. In every case it is feasible that the non-woven fabric produced by the spinning beams arranged in succession, is built up in thickness in the direction of running of the newly formed spinning fabric in the direction of the calender or dryer and roll up device, so that the spinning beam D spins onto the material from the spinning beam C and so on. As a result and if desired, a multifilament layering may be achieved, that is to say, the spun non-woven fabric comprises stratified, superposed, individual layers, which in turn may be varied. The variation may be accomplished both with a view to the filament grouping, as well as with a view to the chemical or physical nature of the polymers that are to be spun. This means that the various spinnerets A or B may also spin different polymers, just as the various spinning beams may spin different polymers, so that one may produce a spun non-woven fabric built up from various layers which are consolidated with the help of the calender J or the saturator K into a multifilament spun non-woven fabric. It is essential in that case, that as a result of the spinning on top of one another of flat, multifilament layers, no crimped or arc-shaped deposited layer will be produced because of the thickness of the fabric. In that case too high elongation under tensile stress will result in the finished product. This is shown in the following schematic outlines of the build-up of the non-woven fabric.

As chemical starting materials for the different spinning polymers, one may mention, for example, polyamide, polyester, polypropylene, polyethylene and copolymers of these substances. Of the physical variations, there may be different thicknesses of the filament, different cross section of the filament (e.g., round and oval), different degrees of crystallization, and/or different points of softening. All these variations or only a few of them may be present in one multifilament non-woven fabric. However, the multifilament fabric may also be built up merely from one and the same substance with one and the same physical characteristics, but it may be distinguished by the fact that it contains different filament aggregates, that is to say individual filaments, groups of double filaments, triple groups, etc. These different groupings may be intermixed laminarly in a random arrangement in one layer; but they may also be disposed on top of one an other in layers and differentiated, depending on whether they have been spun from alternatingly disposed spinnerets in one beam or from different beams with different spinnerets. The groups of filaments of one beam are intermixed moreover mostly by swinging back and forth, for example, making use of the Coanda effect so that the filaments of adjacent spinnerets A and B are sufficiently mixed.

In one process of three-step reinforcement, the multifilament non-woven fabric according to the invention are bonded to produce an essential improvement as compared to the state of the prior art. In the case of this three-step reinforcement, said monofilaments or multifilament groups are first lightly prebonded autogenously by the action of heat and pressure, whereby one uses, for example, monofilaments and binding filaments of low softening temperature produced either by chemical or by physical modification. This prebinding serves to stabilize the fabric and to provide better handling. Then, in a second step, by application of dispersions filaments to be bonded inside of the web is carried out, so that the binders will bind the individual filaments of the filament groups along their parallel segments into multifilament strands. In a third reinforcing step, these spun non-woven fabrics are bonded at the points of filament intersection, are dried and are consolidated at high temperature. As a result of this three-step binding process, one will arrive at a structure which is distinctive with respect to the temperature dependence of the modulus and with respect to the density, surface smoothness and thickness as well. This structure however is eminently suitable for use as a dimensionally stable carrier material for high temperature load. At the same time and as described further above, a bonding together of the individual filaments within the parallel segments into multifilament strands will be achieved. Thin bonding will be described in more detail in FIGS. 5 and 6. The bonding in reinforcement steps 2 and 3 may be combined in particular cases.

The method of building up the spun non-woven fabrics according to this invention from groups of filaments mixed with individual filaments may be employed-as has already been mentioned-very advantageously with respect to various processing techniques, if, for example, the individual filaments are used as binding fibers by having been produced from polymers with a low softening point. Thus, the individual filaments forming the groups or the later multifilaments may be polyethylene terephthalate, while the binding filaments are polyethylene terephthalate-co-isophthalate. In the case of the calendering process J shown in FIG. 1, these binding filaments are activated and subsequently the polyester filaments forming the multifilaments are bonded together into multifilaments in the saturating process K. However, the individual filaments may also be adjusted for this purpose by physical variation, e.g., a lower degree of drawing.

It has already been mentioned that for the production of the high strength spun non-woven fabrics according to this invention, a laminar deposition without any strong crimping, that is to say without any long curves, is of importance since in the case of a curved deposition excessive elongation under load will occur. The filament groups which are bonded together into multifilaments and build up the non-woven fabric represent heterogenous multifilaments which are not spun in a spinning process as so-called heterofilaments, but which are bonded in a processing step separate from the spinning process into heterogenous multifilaments. This has the great advantage that heterogenous multifilaments or heterofilaments may also be proportionately built up from such substances which are not spinnable. Thus, elastomers and duromers or duroplastics may also be used for the production of multifilaments besides thermoplastics. For example, a multifilament from 6 polyester filaments (titer 12 dtex) is bonded with the help of a polyacrylic ester or a melamine formaldehyde resin into a multifilament. Or a multifilament non-woven web may be built up from, e.g., 3 individual filaments of an aromatic polyamide and an epoxy resin into a high temperature resistant multifilament non-woven web. An exceedingly tough multifilament web may be built up from groups of polypropylene filaments bonded into the multifilament fabric with the help of polybutadiene-acrylic nitrile elastomers. The combination of polyester filaments bound with the help of duromers, e.g., melamine/formaldehyde resins, possibly combined with polyacrylic esters into multifilament non-woven fabrics is of importance particularly for the production of carrier materials for roofing sheets or for road construction with bitumen, because thus a laminar structure of high dimensional stability, which is only little deformed by heat, will be achieved. At the same time, above all, a high dimensional stability under various climatic conditions will be provided, as is demanded again and again by the construction industry but which has not until now been achieved. The present invention provides a considerable technical advance in this respect.

Figure 3:
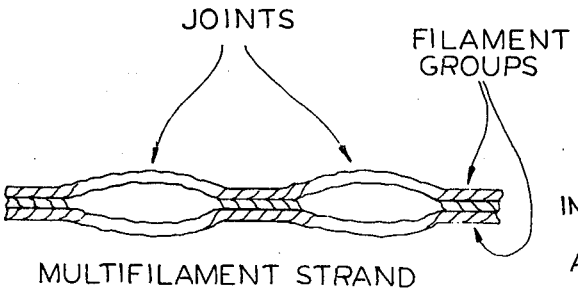
FIG. 3 is a diagrammatic view of a segment of a multifilament strand.

The multifilaments do not have to be available in the form of endless, bonded strands, but the individual filaments forming the multifilament may also be glued together into multifilaments intermittently. It turned out that in many cases, a bonding at certain intervals only, as shown in FIG. 3, was sufficient in order to achieve optimum characteristics, and as a result of a more detailed examination of the structure of the non-woven fabric, this seems understandable. The total web is like any other web material bonded through the fact that the fibers are adhered together at their points of crossing either by binding fibers or with the help of secondary binders, chemicals in the form of binding dispersions or powders. As a result, the bonding of the web is stabilized by fixed points or areas of binding at the points of intersection, and it suffices if the multifilaments are always adhered along such lengths as have been determined by the number of points of crossing. Since in practice the multifilament web is mixed with individual filaments, certain sections of filament groups have a multifilament structure, that is to say individual filaments interconnected in parallel and along other stretches there are partly individual filaments lying separately, which in certain areas may even be separated into individual filaments and are brought together again in yet other portions.

It turned out that this structure confers great advantages in production characteristics. For example, in case of the build-up of a multifilament non-woven fabric from polyester filaments which are bonded to form multifilaments with melamine formaldehyde resin, a complete bonding together over the entire length of the individual filaments into a multifilament results in too great a rigidity of the end product. Where the parallel bonding was accomplished only in segments (as shown schematically in FIG. 3), more flexible areas will result which act like joints and make the total fabric tougher and more elastic. By variation of the size of the segments of multifilament in relation to the unbonded parallel filament stretches, the characteristic of the multifilament non-woven fabric may be varied. For example, a considerable rise in the tear strength or piercing tear strength will occur, whenever sufficient "joints" are present in the non-woven formation. The percentage of bonded segments of filament to the segments of unbonded filament and multifilament may be controlled in the case of the saturation process in FIG. 1 by variation of the binder concentration or absorption, because the binder accumulates, as the result of the surface tension, more preferably between the closely adjacent filaments of the groups. By variation of the weight ratios or of the number of filaments in the groups in relation to the weight ratio of the binder surface substance, a control may be established. By a "blowing up" of the parallel filaments at certain points or stretches, the endless filaments run out of the bonded filament strands and thus form a place for a joint. They later again are bonded into a multifilament strand.

Figure 4:
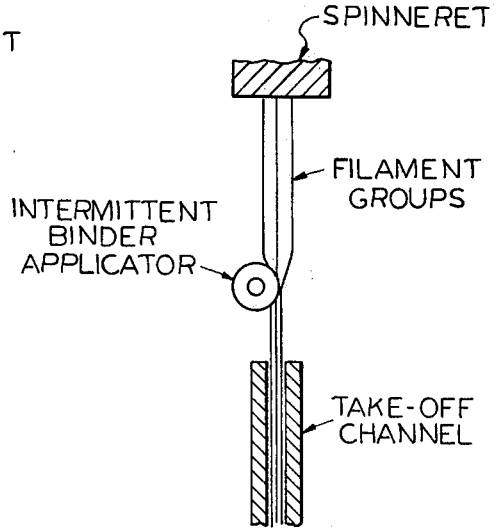
FIG. 4 is a diagrammatic illustration of the process steps of spinning, binder application, and take-off of the formed multifilament strand(s)

The section-bonding of the filament groups into multifilament strands may also be accomplished in such a way that, prior to the entry into the filament guide channels, the filament groups run across coating rolls (FIG. 4), which apply binder intermittently so that an intermittently bonded multifilament according to FIG. 3 develops. The applicator roll for the intermittent application of binder is supplied intermittently with binder by way of a supply system not shown, and the applicator roll transfers these intermittent binder quantities to the filament group.

Figure 5:
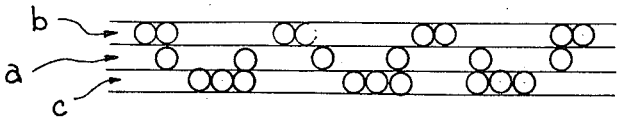
FIG. 5 is a diagram of arrangements of spinning orifices in side-by-side spinnerets.
Figure 6:
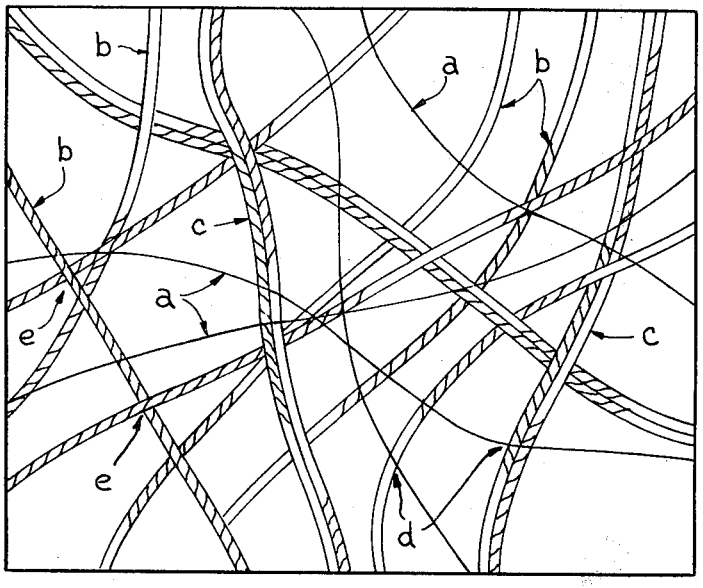
FIG. 6 is a diagrammatic view of typical random arrangements of individual filaments and multifilament strands in the non-woven fabrics of the invention; and, FIGS. 7 and 8 are enlarged microphotographs from an electron stereo microscope of a spun non-woven fabric at enlargements of 50:1 and 200:1.

FIG. 6 shows in top view a spun non-woven fabric according to the invention in the form of a mixed non-woven segment built up from individual filaments and multifilaments. The letter a designates the individual filaments, b shows double groups, c triple groups, e crossing points of multifilaments, and d such crossing points of individual filaments to multifilaments. As explained above, it is advantageous in many cases but not absolutely necessary to use the filaments a as binder filaments. The shaded areas between the individual filaments indicate the secondary binders, which connect the filaments of the groups into multifilaments, e.g., areas of melamine resin to polyester filaments. FIG. 5 illustrates in diagrammatic form three layers in the non-woven fabric of the single filaments a, the double groups b and the triple groups c.

For example, the filaments forming the filament groups b and c may be built up from polyethylene terephthalate of a high degree of draining, while the individual filaments a are built up of polyethylene terephthalate-co-adipate. The shaded areas in FIG. 6 may also be a polyacrylic acid ester modified by trimethylol melamine resin as described further below in a preferred embodiment.

Figure 7:
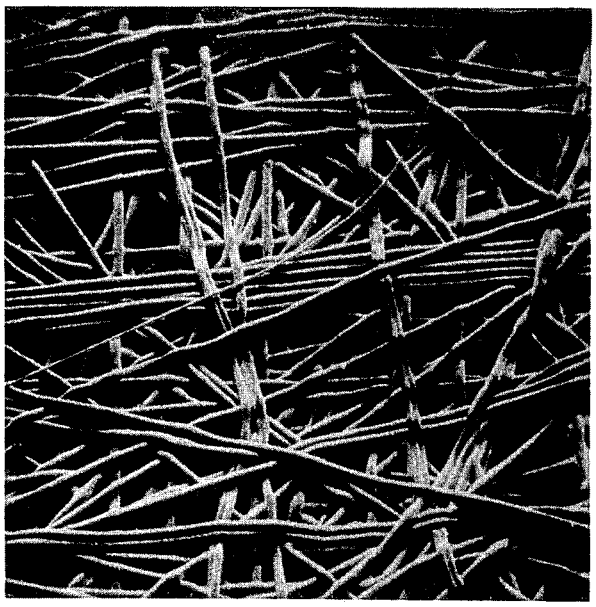

FIG. 7 shows the microphotograph of such a spun non-woven fabric with the electron screen microscope at an enlargement of 50:1, whereby one can very clearly recognize such a multifilament non-woven fabric with fiver groups, double groups and individual filaments.

Figure 8:
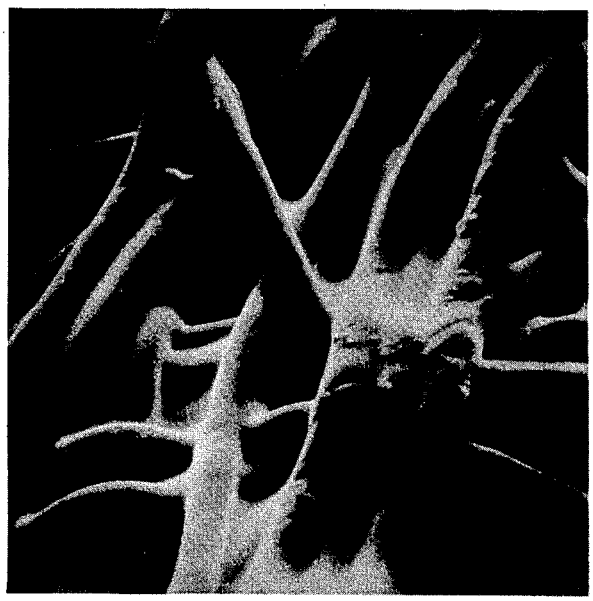

For many purposes of application, the non-woven fabric is bonded at the points of crossing with the same binder system which also binds the multifilament strands. FIG. 8 shows a microphoto of such a binding place produced with the electron screen microscope at an enlargement of 200:1. Here, one can very nicely recognize a multifilament of a triple group.

EXAMPLES

For the production of a spun non-woven fabric according to the invention, a spinning apparatus is used which has spinnerets A and B operating at a fabric width of 5 m and in alternating arrangement, as in FIG. 1. The spinnerets A have 4 rows of spinning holes with a capillary diameter of 0.3 mm in an alternating quintuple and double grouping. The spinnerets B have two rows of individual holes likewise with 0.3 mm of capillaries. Spinnerets A are supplied with polyethylene terephthalate at a melting temperature of 290° and a throughput of 5 g/hole/ minute. Spinnerets B are supplied with polyethylene terephthalate-co-adipate and a throughput of 2.7 g/hole/min. at a melting temperature of 270°.

The groups of filaments formed by the spinnerets are blown below the spinnerets over a stretch of 150 mm transversely to the filament running direction with cool air at a temperature of 38° and are subsequently collectively fed in the form of the parallel filaments to an aerodynamic draining device. Here, the groups of filaments are accelerated to a takeoff speed of 5000 m/min., are oscillated back and forth at a frequency of 675 strokes /min. with the help of Coanda rolls and are deposited up laminarly on a screen belt with subjacent exhaust at a running speed of 10 m/spinning beam, i.e., in the case of three spinning beams, a 30 m/min. running speed results.

Subsequently, the non-woven fabric is prebonded at 95° by a heated calender of 6 m width. The prebonded fabric is saturated with a binder dispersion of a copolymer of 30% styrene, 40% butyl acrylate, 20% acrylonitrile and 5% of methylolated acrylamide and methacrylic acid while using anionic wetting agents, whereby the filament groups are adhered together into multifilament strands (absorption dry 10%). Subsequently, the entire fabric is saturated in a second saturation step with a mixture of a methylolated melamine/formaldehyde precondensate with the above mentioned polyacrylic ester at a ratio of 3:7 and a total binder absorption of 30% related to the weight of the fiber. The fabric is dried with the help of a rotary drier 100° and is subsequently condensed at 130°. The final weight of the multifilament fabric is 230 g/qm.

Especially for the production of high strength carrier materials for roofing sheets, a combination of multifilament groups composed of several polyester filaments bound with polybutyl-acrylic ester/melamine resin combination is best suited. The methylolated melamine resin existing in the combination achieves a particularly high cross linkage and thus bonding of the filament groups to the multifilament strands. Trimethylol-melamine resin at the same time may be replaced either in whole or in part by a polymerized methylol acrylamide ($CH_2=CH—CO\ N\ R_2$). In the example therefore, both a combination with and without methylolated melamine resin is shown. The polymerized acrylonitrile to be sure does not result in a cross linkage but it reduces the glass temperature of the bonding film, as a result of which the adherence of the binder film to the filament groups is improved. A particularly good adhesiveness with the polyester filaments in the groups, that is to say in the binding of the multifilament strands and a particularly good cross linkage result from those which contain reactive groups—COOH and—OH. The butyl acrylate on the basis of its softness results in a good adhesion, the cross linkage groups will then reduce the softness in case of the condensation and will result in a high module of the end product, above all also in the case of high temperatures.

Thus a spun non-woven fabric of polyester filament groups bonded with polybutyl acrylic ester copolymerizates into heteroneous multifilament strands represents a particularly preferred variation according to the invention, which strands are cross linked with the help of carboxyl- and N-methylol groups.

The preferred thickness of the filament lies between 6 and 15 dtex with round cross section and with a softening point above 150° C., whereby the modulus measured at a 5 cm width, is adjusted as follows:

| | |
|---|---|
| In the case of 3% elongation | 270 newton |
| In the case of 5% elongation | 315 newton |
| In the case of 10% elongation | 380 newton |

It turns out that the cross linkage of the strands must be carried out with a careful increase in temperature, for which reason in the example it was at first predried at 100° and finally condensed at 150°. Thereby, an optimum cross linkage between the various components will be achieved. In the case of too quick an increase in temperature, each component is cross linked by itself and no optimum moduli or strengths of the multifilament strands or of the spun non-woven fabrics produced from them will be achieved.

It will be appreciated from the foregoing that the invention herein can take many forms other than the preferred forms described above and/or shown in the drawings and that the invention as herein claimed in not limited to the described and/or illustrated embodiments.

I claim:

1. A non-woven fabric comprising a plurality of superimposed layers of essentially endless uncrimped filaments in an interconnected, tangled relationship, deposited laminarly without the formation of arcs, said layers of filaments comprising both single filaments and filament groups; wherein said filament groups are multifilament strands comprising individual filaments which are disposed, at least at certain segments thereof, parallel to one another, and which individual filaments of said groups have been drawn and cured to a non-tacky state to prevent autogenous bonding; and wherein the parallel filaments within the filament groups and the single filaments are bonded together using binders comprising dispersions or powders of polymers or copolymers.

2. A non-woven fabric as recited in claim 1, wherein the filament groups comprise heterogeneous multifilament strands which consist of individual filaments of different chemical composition, different physical characteristics or different cross-sections.

3. A non-woven fabric as recited in claim 1, characterized by the filament groups, comprising heterogeneous multifilament strands made from filaments of at least two different polyesters, being bonded in the form of said parallel segments by binders which are cross-linked with methylol groups.

4. A non-woven fabric as recited in claim 1, characterized by the multifilament strands comprising polyethylene terephthalate filaments which are bonded together with polybutyl acrylate as a binder into said multifilament strands, which strands are cross-linked by N-methylol modified monomers in the form of copolymers.

5. A non-woven fabric as recited in claim 1, characterized in that individual filaments and filament groups are present in a ratio of 2:1.

6. A non-woven fabric as recited in claim 1, characterized by the filament groups comprising a mixture of thermoplastic, individual filaments which are bonded together with thermoplastics, elastomers or duromers.

7. A non-woven fabric as recited in claim 1 made up of filaments and filament groups which comprise, in addition to drawn and cured filaments, filaments made from non-spinnable materials.

8. A non-woven fabric as recited in claim 7 wherein the non-spinnable materials comprise elastomers, duromers or duroplastics.

9. A non-woven fabric as recited in claim 1 which is stratified by the physical or chemical properties of the individual filaments and filament groups being varied from one layer to the next.

10. A non-woven fabric as recited in claim 1, characterized by the filament groups, comprising heterogenous multifilament strands made from filaments of a single polyester composition, being bonded in the form of said parallel segments by binders which are cross-linked with methylol groups.

11. A non-woven fabric roofing sheet or road construction carrier material saturated with bitumen comprising a plurality of superimposed layers of essentially endless, uncrimped filaments in an interconnected, tangled relationship deposited laminarly without the formation of arcs; said layers of filaments comprising both single filaments and filament groups; wherein said filament groups are multifilament strands comprising individual filaments which are disposed, at least at certain segments thereof, parallel to one another, and which individual filaments thereof have been drawn and cured to a non-tacky state to prevent autogenous bonding; and wherein the parallel filaments within the filament groups and the single filaments are bonded together using binders comprising dispersions or powders of polymers or copolymers.

12. A process for the production of a non-woven fabric comprising a plurality of superimposed layers of essentially endless, uncrimped filaments, laminarly deposited, in an interconnected, tangled relationship, characterized by both single filaments and filament groups, comprising:

(a) spinning individual filaments from a multiplicity of spinnerets;

(b) drawing the spun, individual filaments aerodynamically in a moving gas stream;

(c) curing the drawn individual filaments to a non-tacky state by cooling;

(d) laying down a portion of the cured filaments as essentially parallel filament groups; while simultaneously (e) laying down the portion of cured filaments not laid down as parallel filament groups to form a web comprising both filament groups and single filaments; and (f) bonding the parallel groups of filaments and the individual filaments at their points of random crossing using binders comprising dispersions or powders of polymers or copolymers.

13. A process as set forth in claim 12, characterized in that the individual filaments and the filament groups prior to the application of the secondary binders which bind the parallel filament segments into multifilaments, are prebonded first by additional, proportionally spun individual filaments which bond under heat and/or pressure applied to the composite group of spun filaments.

14. A process as set forth in claim 12, characterized in that all of the filaments to be bonded together in the multifilament strands are bonded into said strands, and thereafter the bonding of the individual filaments in the fabric at least at their points of crossing is carried out with the help of thermoplastic binder-filaments.

15. A process as set forth in claim 12, characterized in that the filaments of the multifilament strands are polyester filaments bonded with the help of polybutyl acrylates modified with methylol groups.

16. A process as set forth in claim 15, characterized in that the bonding of the polyester filaments into multifilament strands is accomplished with the simultaneous use of methylolated melamine resins as binders.

17. The process as recited in claim 12 wherein the filaments are spun from a multiplicity of spinnerets which are disposed side by side.

18. The process as recited in claim 12 wherein binding filaments are disposed within the fabric web and the binding of the filaments and filament groups comprises the steps of:

applying heat and pressure to lightly prebind the filaments and filament groups with the low softening temperature binding filaments; applying polymer dispersions or copolymers to bond the individual filaments of the filament groups together along their parallel segments into multifilament strands, and to bond the filaments to the filament groups at their points of crossing; and heating the non-woven fabric to dry and consolidate the filaments and filament groups.

19. The process as recited in claim 12 wherein the parallel individual filaments comprising the filament groups are, after curing to a non-tacky state, bonded together at various locations along their lengths prior to being laid down to form a web using binders comprising dispersions or powders of polymers or copolymers.

* * * * *